US008864110B2

(12) United States Patent
Xu

(10) Patent No.: US 8,864,110 B2
(45) Date of Patent: Oct. 21, 2014

(54) FENCE POST AND FENCE FORMED THEREFROM

(75) Inventor: Lv Xu, Zhangjiagang (CN)

(73) Assignee: Zhangjiagang Goldnet Fencing System Co., Ltd., Jiangsu (CN)

( * ) Notice: Subject to any disclaimer, the term of this patent is extended or adjusted under 35 U.S.C. 154(b) by 0 days.

(21) Appl. No.: 13/636,251

(22) PCT Filed: Sep. 30, 2010

(86) PCT No.: PCT/CN2010/077510

§ 371 (c)(1),
(2), (4) Date: Sep. 20, 2012

(87) PCT Pub. No.: WO2011/127721

PCT Pub. Date: Oct. 20, 2011

(65) Prior Publication Data

US 2013/0009121 A1 Jan. 10, 2013

(30) Foreign Application Priority Data

Apr. 13, 2010 (CN) ..... 2010 1 0149257

(51) Int. Cl.
*E04H 17/10* (2006.01)
*E04H 17/20* (2006.01)
*E04H 17/16* (2006.01)

(52) U.S. Cl.
CPC ..... *E04H 17/20* (2013.01); *E04H 17/161* (2013.01); *Y10S 256/05* (2013.01)
USPC ..... 256/47; 256/DIG. 5

(58) Field of Classification Search
USPC ..... 256/47, 52, 54, DIG. 5
See application file for complete search history.

(56) References Cited

U.S. PATENT DOCUMENTS

| | | | | | |
|---|---|---|---|---|---|
| 2,887,333 | A * | 5/1959 | Shield | 403/217 |
| 4,910,933 | A * | 3/1990 | Schwarzfeller et al. | 256/47 |
| 5,275,382 | A * | 1/1994 | Charbaut et al. | 256/48 |
| 6,010,116 | A * | 1/2000 | Knott, Sr. | 256/47 |
| 6,481,926 | B2 * | 11/2002 | Benedict et al. | 405/21 |
| 2003/0209701 | A1 | 11/2003 | Goddard | |
| 2005/0116213 | A1 * | 6/2005 | Dahowski et al. | 256/24 |
| 2009/0146123 | A1 * | 6/2009 | Hewitt et al. | 256/45 |

FOREIGN PATENT DOCUMENTS

| | | | |
|---|---|---|---|
| CN | 2778872 | | 5/2006 |
| CN | 2778987 | | 5/2006 |
| CN | 101824935 | | 9/2010 |
| EP | 1479854 | A1 * | 11/2004 |
| EP | 1736617 | | 12/2006 |
| EP | 1980688 | A1 * | 10/2008 |
| EP | 2039853 | | 3/2009 |
| EP | 2088262 | A1 * | 8/2009 |
| FR | 2780432 | | 12/1999 |
| FR | 2872191 | A3 * | 12/2005 |
| JP | 8291648 | | 11/1996 |

* cited by examiner

*Primary Examiner* — Joshua Kennedy
(74) *Attorney, Agent, or Firm* — Vidas, Arrett & Steinkraus

(57) ABSTRACT

In some embodiments, a fence post comprises a first body provided with first left hook parts and first right hook parts that are respectively positioned in front of the corresponding side wing. A fence body may be installed between two fence posts. In some embodiments, a second body conceals openings of the first left hook parts and the first right hook parts.

12 Claims, 5 Drawing Sheets

FENCE POST AND FENCE FORMED THEREFROM

CROSS-REFERENCE TO RELATED APPLICATIONS

This is a national stage application of PCT Application No. PCT/CN2010/077510, filed on Sep. 30, 2010, the entire content of which is hereby incorporated herein by reference.

FIELD OF THE INVENTION

The present invention relates to a metal fence post and the fence formed therefrom.

DESCRIPTION OF THE RELATED ART

As shown in FIG. 1, large fences are generally made up of a plurality of mesh panels, the end of which are arranged to the fence posts disposed between the mesh panels through an fastening means. However, there exist lots of problems with such connection type between the fence and the fence post in use: 1. the inconvenience and the low installation efficiency resulted from the fastening means; 2. the insecurity caused by the dismountable fastening means; 3. the poor anti-corrosion ability of the fastening means easily leading to oxidation corrosion in the outdoors environments; and 4. the predefined locations on the fence post for connecting the fastening means leading to restrictions for the installation environment, especially for the low-lying areas.

SUMMARY OF THE INVENTION

An object of the present invention is to provide a fence post that is convenient for assembling and hard to break.

A further object of the present invention is to provide a fence that is convenient for assembling and difficult to break.

In order to obtain one or more of these objects, the present invention provides a fence post in one aspect, comprising a first body provided with a first base part extending along the vertical direction for fixing to the fixed objects, wherein, the front end of the first base part comprises a left front end extending leftwards forming a first left side wing, and a right front end extending rightwards forming a first right side wing, whereby, certain parts of the first left side wing bend to form a plurality of first left hook parts distributed along one vertical line, each of which is provided with a rightward oriented opening positioned in front of the first left side wing; and certain parts of the first right side wing bend to form a plurality of first right hook parts distributed along another vertical line, each of which is provided with a leftward oriented opening positioned in front of the first right side wing.

Preferably, the first body is made of a metal panel through a constant bending treatment.

Preferably, the first left hook parts and the first right hook parts are in an interlacing arrangement along the vertical direction, more preferably, one after the other.

In another broad aspect, the present invention provides a fence post, comprising a first body provided with a first base part extending along the vertical direction for fixing to the fixed objects and a second body, wherein, the front end of the first base part comprises a left front end extending leftwards forming a first left side wing, and a right front end extending rightwards forming a first right side wing, whereby, certain parts of the first left side wing bend to form a plurality of first left hook parts distributed along one vertical line, each of which is provided with a rightward oriented opening positioned in front of the first left side wing; and certain parts of the first right side wing bend to form a plurality of first right hook parts distributed along another vertical line, each of which is provided with a leftward oriented opening positioned in front of the first right side wing; thus the second body covering over the first left hook parts and the first right hook parts after the assembling of the first body and the second body, such that the openings of the first left hook parts and the first right hook parts are concealed under the second body.

Preferably, the first base part is provided with a cavity internally.

Preferably, the first body and the second body are respectively made of a metal panel through a constant bending treatment.

Preferably, the first left hook parts and the first right hook parts are in an interlacing arrangement along the vertical direction.

More preferably, the first left hook parts and the first right hook parts are in an interlacing arrangement along the vertical direction one after the other.

In still another aspect, the present invention provides a fence post, comprising a first body provided with a first base part extending along the vertical direction for fixing to the fixed objects and a second body provided with a second base part extending along the vertical direction, wherein, the front end of the first base part comprises a left front end extending leftwards forming a first left side wing, and a right front end extending rightwards forming a first right side wing, whereby, certain parts of the first left side wing bend to form a plurality of first left hook parts distributed along a first vertical line, each of which is provided with a rightward oriented opening positioned in front of the first left side wing; and certain parts of the first right side wing bend to form a plurality of first right hook parts distributed along a second vertical line, each of which is provided with a leftward oriented opening positioned in front of the first right side wing;

and the second base part comprises a left back end extending leftwards forming a second left side wing, and a right back end extending rightwards forming a second right side wing, whereby, certain parts of the second left side wing bend to form a plurality of second left hook parts distributed along a third vertical line, each of which is provided with a rightward oriented opening positioned behind the second left side wing; and certain parts of the second right side wing bend to form a plurality of second right hook parts distributed along a fourth vertical line, each of which is provided with a leftward oriented opening positioned behind the second right side wing;

thus the second body covering over the first left hook parts and the first right hook parts after the assembling of the first body and the second body, such that the openings of the first left hook parts are concealed under the second left side wing, while the openings of the first right hook parts are concealed under the second right side wing, whereby, the first left hook parts and the second left hook parts are in an interlacing arrangement along the vertical direction, while the first right hook parts and the second right hook parts are in an interlacing arrangement along the vertical direction.

Preferably, the first body and the second body are respectively made of a metal panel through a constant bending treatment.

Preferably, the first base part is provided with a cavity internally, the cross section of which is more preferably in a semicircular or hexagon shape.

Preferably, the first body and the second body are provided with the same structure and are integrated along the opposite direction into a whole.

Preferably, the first left hook parts and the first right hook parts are in an interlacing arrangement along the vertical direction, and the second left hook parts and the second right hook parts are in an interlacing arrangement along the vertical direction, whereby, after the assembling of the first body and the second body, the first left hook parts and the second left hook parts are in an interlacing arrangement along the vertical direction, while the first right hook parts and the second right hook parts are in an interlacing arrangement along the vertical direction. More preferably, the first left hook parts and the first right hook parts are in an interlacing arrangement along the vertical direction one after the other, while the second left hook parts and the second right hook parts are in an interlacing arrangement along the vertical direction one after the other.

In a fourth aspect, the present invention provides a fence comprising a plurality of fence units, each of which comprises a pair of fence posts disposed on either left or right side and a fence body arranged between the pair of fence posts. The fence post comprises a first body provided with a first base part extending along the vertical direction for fixing to the fixed objects, wherein, the front end of the first base part comprises a left front end extending leftwards forming a first left side wing, and a right front end extending rightwards forming a first right side wing, whereby, certain parts of the first left side wing bend to form a plurality of first left hook parts distributed along one vertical line, each of which is provided with a rightward oriented opening positioned in front of the first left side wing; and certain parts of the first right side wing bend to form a plurality of first right hook parts distributed along another vertical line, each of which is provided with a leftward oriented opening positioned in front of the first right side wing. After the fence body arranged to the pair of fence posts, the left side of the fence body hooks to the first right hook parts of the fence post on the left, and the right side of the fence body hooks to the first left hook parts of the fence post on the right.

Preferably, the first body is made of a metal panel through a constant bending treatment.

Preferably, the first left hook parts and the first right hook parts are in an interlacing arrangement along the vertical direction, more preferably, one after the other.

Preferably, the fence body can be the wallboard, the metal mesh or the grating structures.

In a fifth aspect, the present invention provides a fence comprising a plurality of fence units, each of which comprises a pair of fence posts disposed on either left or right side and a fence body arranged between the pair of fence posts. The fence post comprises a first body provided with a first base part extending along the vertical direction for fixing to the fixed objects and a second body, wherein, the front end of the first base part comprises a left front end extending leftwards forming a first left side wing, and a right front end extending rightwards forming a first right side wing, whereby, certain parts of the first left side wing bend to form a plurality of first left hook parts distributed along one vertical line, each of which is provided with a rightward oriented opening positioned in front of the first left side wing; and certain parts of the first right side wing bend to form a plurality of first right hook parts distributed along another vertical line, each of which is provided with a leftward oriented opening positioned in front of the first right side wing. After the fence body arranged to the pair of fence posts, the left side of the fence body hooks to the first right hook parts of the fence post on the left, and the right side of the fence body hooks to the first left hook parts of the fence post on the right, while the openings of the first left hook parts and the first right hook parts are concealed under the second body.

Preferably, the first body and the second body are respectively made of a metal panel through a constant bending treatment.

Preferably, the first base part is provided with a cavity internally, the cross section of which is more preferably in a semicircular or hexagon shape.

Preferably, the first left hook parts and the first right hook parts are in an interlacing arrangement along the vertical direction, more preferably, one after the other.

Preferably, the fence body can be the wallboard, the metal mesh or the grating structures.

In a sixth aspect, the present invention provides a fence comprising a plurality of fence units, each of which comprises a pair of fence posts disposed on either left or right side and a fence body arranged between the pair of fence posts.

The fence post comprises a first body provided with a first base part extending along the vertical direction for fixing to the fixed objects and a second body provided with a second base part extending along the vertical direction, wherein, the front end of the first base part comprises a left front end extending leftwards forming a first left side wing, and a right front end extending rightwards forming a first right side wing, whereby, certain parts of the first left side wing bend to form a plurality of first left hook parts distributed along a first vertical line, each of which is provided with a rightward oriented opening positioned in front of the first left side wing; and certain parts of the first right side wing bend to form a plurality of first right hook parts distributed along a second vertical line, each of which is provided with a leftward oriented opening positioned in front of the first right side wing;

and the second base part comprises a left back end extending leftwards forming a second left side wing, and a right back end extending rightwards forming a second right side wing, whereby, certain parts of the second left side wing bend to form a plurality of second left hook parts distributed along a third vertical line, each of which is provided with a rightward oriented opening positioned behind the second left side wing; and certain parts of the second right side wing bend to form a plurality of second right hook parts distributed along a fourth vertical line, each of which is provided with a leftward oriented opening positioned behind the second right side wing;

thus the second body covering over the first left hook parts and the first right hook parts after the assembling of the first body and the second body, such that the openings of the first left hook parts are concealed under the second left side wing, while the openings of the first right hook parts are concealed under the second right side wing, whereby, the first left hook parts and the second left hook parts are in an interlacing arrangement along the vertical direction, while the first right hook parts and the second right hook parts are in an interlacing arrangement along the vertical direction. After the fence body arranged to the pair of fence posts, the second body covers over the first left hook parts and the first right hook parts such that the openings of the first left hook parts are concealed under the second left side wing, while the openings of the first right hook parts are concealed under the second right side wing, wherein, the first left hook parts and the second left hook parts are in an interlacing arrangement along the vertical direction one after the other at the left side of the fence post, while the first right hook parts and the second right hook parts are in an interlacing arrangement along the vertical direction one after the other at the right side of the fence post. The left side of the fence body hooks to both the first right hook parts and the second right hook parts of the fence post on the left, and the right side of the fence body hooks to both the first left hook parts and the second left hook parts of the fence post on the right.

Preferably, the first body and the second body are respectively made of a metal panel through a constant bending treatment.

Preferably, the first base part is provided with a cavity internally.

Preferably, the cross section of the cavity is preferably in a semicircular or hexagon shape.

Preferably, the first left hook parts and the first right hook parts are in an interlacing arrangement along the vertical direction, and the second left hook parts and the second right hook parts are in an interlacing arrangement along the vertical direction, whereby, after the assembling of the first body and the second body, the first left hook parts and the second left hook parts are in an interlacing arrangement along the vertical direction, while the first right hook parts and the second right hook parts are in an interlacing arrangement along the vertical direction.

More preferably, the first left hook parts and the first right hook parts are in an interlacing arrangement along the vertical direction one after the other, while the second left hook parts and the second right hook parts are in an interlacing arrangement along the vertical direction one after the other.

Preferably, the fence body can be the wallboard, the metal mesh or the grating structures.

Preferably, the first body and the second body are provided with the same structure and are integrated along the opposite direction into a whole.

The present invention has the following advantages:

1. as the first left hook parts and the first right hook parts of the first body are respectively positioned in front of the corresponding side wing, it is easy to install the fence body between two fence posts directly with great convenience;

2. owning to the second body for concealing the openings of the first left hook parts and the first right hook parts in front of the first body, it is impossible to break the fence from the first left hook parts and the first right hook parts after the assembling of the first body and the second body, ensuring the safety and reliability of the fence post and the fence formed therefrom.

BRIEF DESCRIPTION OF THE DRAWINGS

The present invention will become more fully understood from the following detailed description of the preferred, but non-limiting embodiments thereof, described in connection with the accompanying drawings in which.

DETAILED DESCRIPTION OF THE PREFERRED EMBODIMENTS

The detailed description of the preferred embodiment according to the invention is given as below with the accompanying drawings so that the benefits and features of the present invention are understood for those skilled in the art, making an definition of the protection scope of the present invention. Throughout the drawings, like numerals will be used to identify similar features except where expressly otherwise indicated.

The orientations in the following embodiments, for example "upper", "lower", "left", "right", "front", and "back", are defined after the fence post embedded to the fixed objects, such as the ground, the toe wall or the like.

First Exemplary Embodiment

Figure 1:
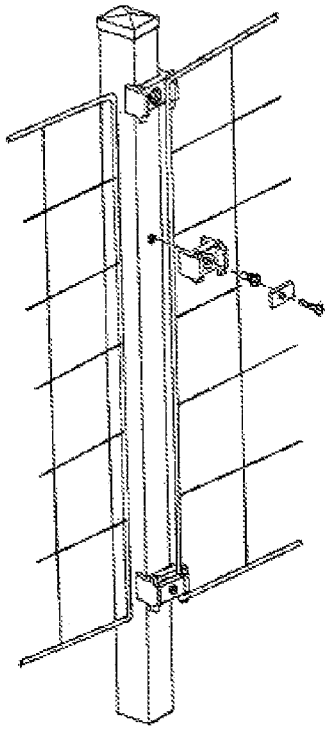
PRIOR ART FIG. 1
FIG. 1 shows a perspective view of the fence post in the prior art.
Figure 2:
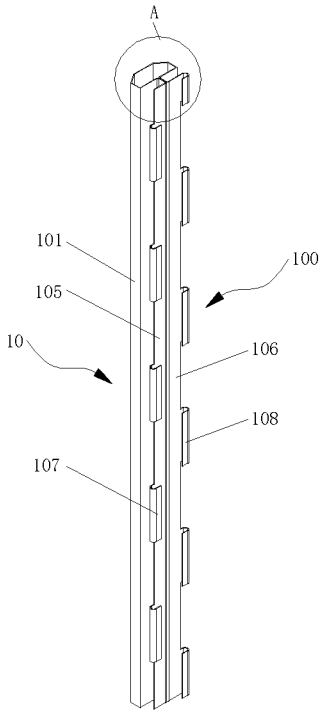
FIG. 2 shows a perspective view of a first preferred embodiment of a fence post in accordance with the present invention.
Figure 3:
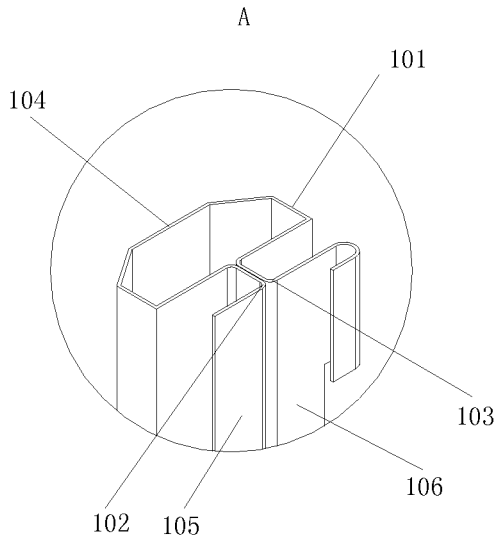
FIG. 3 shows an enlarged view illustrating the details of A in FIG. 2.

FIGS. 2 and 3 show a first preferred embodiment of the fence post 100 in accordance with the present invention, comprising a first body 10 made of a metal panel through a constant bending treatment. The first body 10 is provided with a first base part 101 extending along the vertical direction for fixing to the fixed objects (such as the ground). The front end of the first base part 101 comprises a left front end 102 and a right front end 103, and the back end of the first base part 101 comprises a bending part 104, which connects the left front end 102 and the right front end 103 and bends backwards. Thus, the first base part 101 is provided with a hollow structure having a cavity inside, the cross section of which is preferably in a semicircular or hexagon shape, while the shape of the bending part 104 is shown in FIG. 3. The hollow structure of the first base part 101 is suitable for internally concealing electrical installations like electric wires, infrared detectors, or the motion detectors. A transition connection part is respectively arranged between the left front end 102 and the bending part 104, and between the right front end 103 and the bending part 104 by the riveting machine, for reinforcing the strength of the first base part 101.

The left front end 102 extends leftwards forming a first left side wing 105, and the right front end 103 extends rightwards forming a first right side wing 106, wherein, certain parts of the first left side wing 105 bend to form a plurality of first left hook parts 107 distributed along one vertical line, each of which is provided with a rightward oriented opening positioned in front of the first left side wing 105; and certain parts of the first right side wing 106 bend to form a plurality of first right hook parts 108 distributed along another vertical line, each of which is provided with a leftward oriented opening positioned in front of the first right side wing 106. As shown in FIG. 2, there exist five first left hook parts 107 and six first right hook parts 108 in an interlacing arrangement along the vertical direction, preferably, one after the other.

In this embodiment, as the first left hook parts 107 and the first right hook parts 108 are respectively positioned in front of the corresponding side wing, it is easy for the installers to hook the two ends of the fence body up to the first left hook parts 107 or the first right hook parts 108 respectively when installing the fence body between two fence posts 100.

Second Exemplary Embodiment

Figure 4:
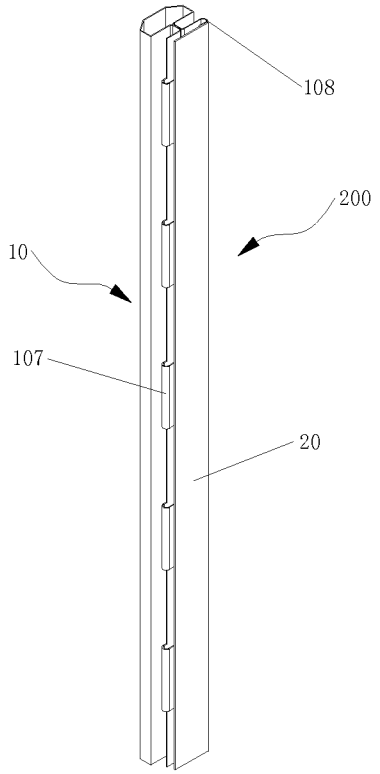
FIG. 4 shows a perspective view of a second preferred embodiment of a fence post in accordance with the present invention.

As shown in FIG. 4, the fence post 200 of this embodiment comprises a first body 10 and a second body 20, wherein, the first body 10 of this embodiment is provided with the same structure with that of the first embodiment which is not intended to describe herein-below, while the structure of the second body 20 is described as below.

The second body 20 is provided with a capping-like structure that covers over the first left hook parts 107 and the first right hook parts 108 after the assembling of the first body 10 and the second body 20, such that the openings of the first left hook parts 107 and the first right hook parts 108 are concealed under the second body 20.

The second body 20 of this embodiment is adapted to cover the openings of the first left hook parts 107 and the first right hook parts 108 effectively, thus preventing the fence post from being broken at the openings of the first left hook parts 107 and the first right hook parts 108.

Third Exemplary Embodiment

Figure 6:
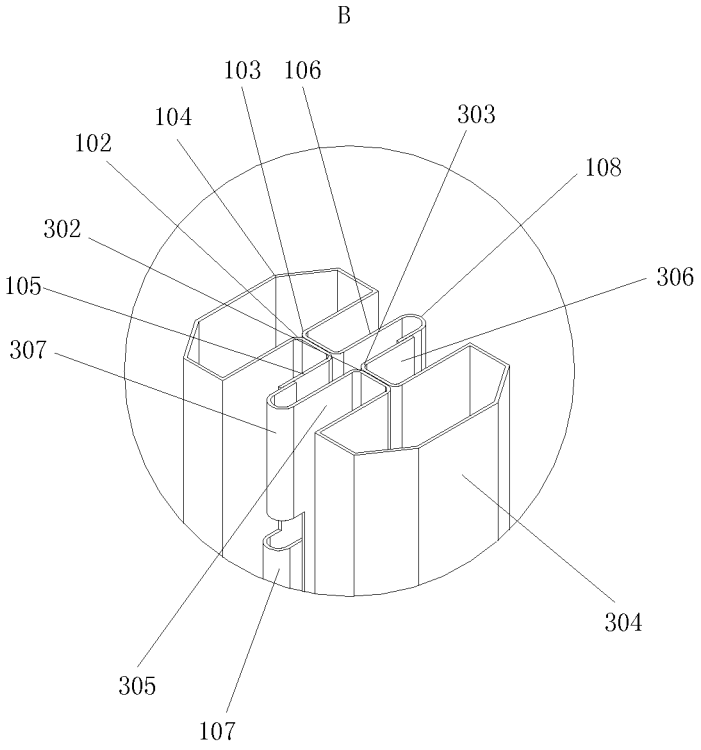
FIG. 6 shows an enlarged view illustrating the details of B in FIG. 5.
Figure 5:
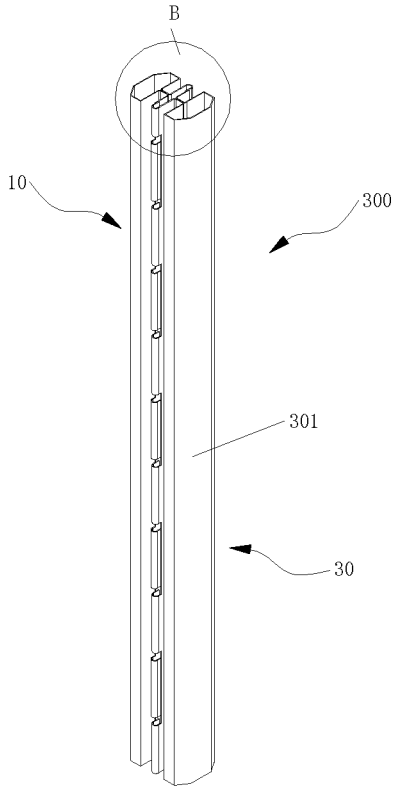
FIG. 5 shows a perspective view of a third preferred embodiment of a fence post in accordance with the present invention.

As shown in FIGS. 5 and 6, the fence post 300 of this embodiment comprises a first body 10 and a second body 30, wherein, the first body 10 of this embodiment is provided with the same structure with that of the first and the second embodiment, while the structure of the second body 30 is described as below.

The second body 30, which is provided with a second base part 301 extending along the vertical direction for fixing to the fixed objects (such as the ground), is made of a metal panel through a constant bending treatment. The back end of the second base part 301 comprises a left back end 302 and a right back end 303, and the front end of the second base part 301 comprises a bending part 304 which connects the left back end 302 and the right back end 303 and bends forwards. Thus, the second base part 301 is provided with a hollow structure having a cavity inside, the cross section of which is preferably in a semicircular or hexagon shape, while the shape of the bending part 304 is shown in FIG. 6. The hollow structure of the second base part 301 is suitable for internally concealing electrical installations like electric wires, infrared detectors, or the motion detectors. A transition connection part is respectively arranged between the left back end 302 and the bending part 304, and between the right back end 303 and the bending part 304 also by the riveting machine, for reinforcing the strength of the second base part 301.

The left back end 302 extends leftwards forming a second left side wing 305, and the right back end 303 extends rightwards forming a second right side wing 306, wherein, certain parts of the second left side wing 305 bend to form a plurality of second left hook parts 307 distributed along one vertical line, each of which is provided with a rightward oriented opening positioned behind the second left side wing 305; and certain parts of the second right side wing 306 bend to form a plurality of second right hook parts (not depicted) distributed along another vertical line, each of which is provided with a leftward oriented opening positioned behind the second right side wing 306. As shown in FIG. 5, the second left hook parts 307 and the second right hook parts are in an interlacing arrangement along the vertical direction, preferably, one after the other.

It is understood from the above descriptions that, for the convenience of fabrication, the second body 30 can have the same structure with the first body 10, which means that the first body 10 can also serve as the second body 30. In this case, the first left hook part of the first base body 10 serves as the second right hook part. Similarly, the first right hook part serves as the second left hook part.

The second body 30 of this embodiment is adapted to effectively cover the openings of the first left hook parts 107 and the first right hook parts 108 after the assembling of the first body 10 and the second body 30, thus preventing the fence post from being broken at the openings of the first left hook parts 107 and the first right hook parts 108. Further more, owning to the second left hook parts 307 and the second right hook parts of the second body 30, after the assembling of the first body 10 and the second body 30, the first left hook parts 107 and the second left hook parts 307 are in an interlacing arrangement along the vertical direction one after the other at the left side of the fence post 300, while the first right hook parts 108 and the second right hook parts are in an interlacing arrangement along the vertical direction one after the other at the right side of the fence post 300. Thus after the fence body arranged between a pair of fence posts, the fence body gets tighter once being pulled leftwards or rightwards, protecting the fence body from being broken.

Fourth Exemplary Embodiment

Figure 7:
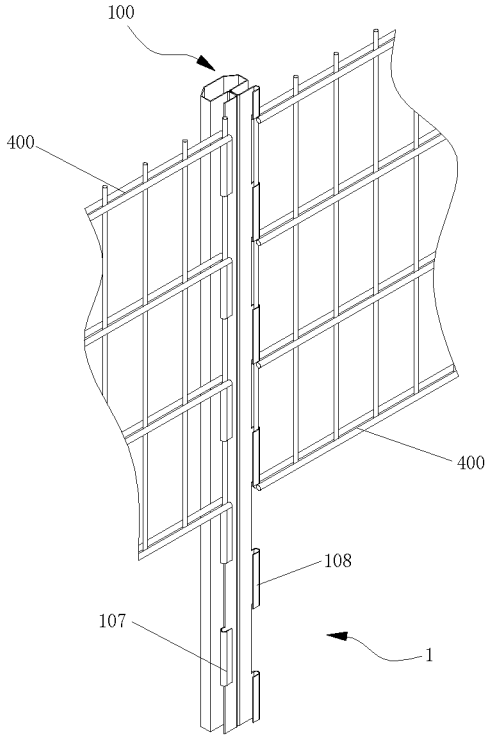
FIG. 7 shows a perspective view of a fourth preferred embodiment of a fence post in accordance with the present invention.

As shown in FIG. 7, the fence of this embodiment comprises a plurality of fence units 1, each of which comprises a pair of fence posts 100 and a fence body 400 arranged between the pair of fence posts 100, wherein, the fence body 400 can be the wallboard, the metal mesh or the grating structures, and the fence posts 100 of this embodiment adopt the structure described in the first preferred embodiment. After the fence body 400 arranged to the pair of fence posts 100, the left side of the fence body 400 hooks to the first right hook parts 108 of the fence post 100 on the left, and the right side of the fence body 400 hooks to the first left hook parts 107 of the fence post 100 on the right.

Fifth Exemplary Embodiment

Figure 8:
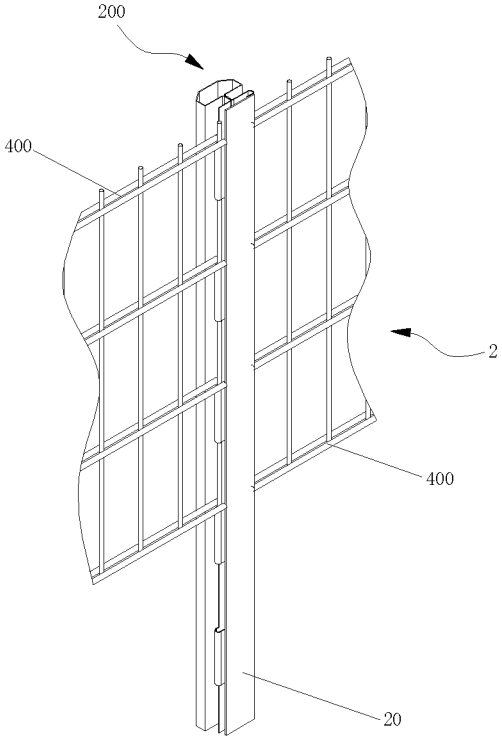
FIG. 8 shows a perspective view of a fifth preferred embodiment of a fence post in accordance with the present invention.

As shown in FIG. 8, the fence of this embodiment comprises a plurality of fence units 2, each of which comprises a pair of fence posts 200 and a fence body 400 arranged between the pair of fence post 200, wherein, the fence body 400 can be the wallboard, the metal mesh or the grating structures, and the fence posts 200 of this embodiment adopt the structure described in the second preferred embodiment.

After the fence body 400 arranged to the pair of fence posts 200, the left side of the fence body 400 hooks to the first right hook parts 108 of the fence post 200 on the left, and the right side of the fence body 400 hooks to the first left hook parts 107 of the fence post 200 on the right, while the second body 20 covers over the first left hook parts 107 and the first right hook parts 108 such that the openings of the first left hook parts 107 and the first right hook parts 108 are concealed under the second body 20.

Sixth Exemplary Embodiment

Figure 9:
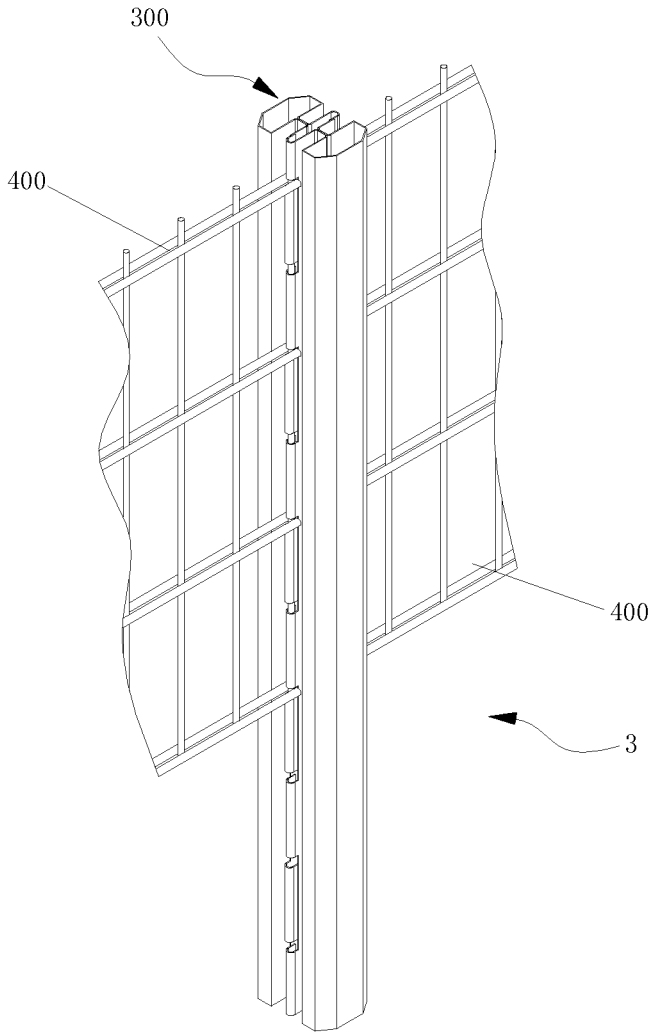
FIG. 9 shows a perspective view of a sixth preferred embodiment of a fence post in accordance with the present invention.

As shown in FIG. 9, the fence of this embodiment comprises a plurality of fence units 3, each of which comprises a pair of fence posts 300 and a fence body 400 arranged between the pair of fence posts 300, wherein, the fence body 400 can be the wallboard, the metal mesh or the grating structures, and the fence posts 300 of this embodiment adopt the structure described in the third preferred embodiment.

After the fence body 400 arranged to the pair of fence posts 300, the second body 30 covers over the first left hook parts 107 and the first right hook parts 108 such that the openings of the first left hook parts 107 are concealed under the second left side wing 305, while the openings of the first right hook parts 108 are concealed under the second right side wing 306, wherein, the first left hook parts 107 and the second left hook parts 307 are in an interlacing arrangement along the vertical direction one after the other at the left side of the fence post 300, while the first right hook parts 108 and the second right hook parts are in an interlacing arrangement along the vertical direction one after the other at the right side of the fence post 300. The left side of the fence body 400 hooks to both the first right hook parts 108 and the second right hook parts of the fence post 300 on the left, and the right side of the fence body 400 hooks to both the first left hook parts 107 and the second left hook parts 307 of the fence post 300 on the right.

Throughout the embodiments, the first body and the second body are both made of steel for example steel strips by rolling or cutting, preferably of the galvanized steel.

The above description is meant to be exemplary only and is not limited to the example shown in the drawings and described hereinbefore, and those skilled in the art will recognize that changes may be made to the embodiment described without department from the scope of the invention disclosed. Still other modifications varied in efferent manners which fall within the scope of the present invention and their technical equivalents will be apparent to those skilled in the art, in light of a review of this disclosure, and such modifications are intended to fall within the appended claims.

What is claimed is:

1. A fence post comprising:

a first body and a second body, each of the first and second bodies comprising:

a base portion, a left side wing and a right side wing;

said left side wing comprising a plurality of left hook portions and a plurality of left non-hook portions, each of the left hook portions defining a vertical gap having a rightward oriented opening positioned in front of the left side wing, said left hook portions aligned with one another, said left hook portions and said left non-hook portions alternating along a length of said left side wing;

said right side wing comprising a plurality of right hook portions and a plurality of right non-hook portions, each of the right hook portions defining a vertical gap having a leftward oriented opening positioned in front of the right side wing, said right hook portions aligned with one another, said right hook portions and said right non-hook portions alternating along a length of said right side wing;

wherein each of said left hook portions is aligned with one of said right non-hook portions, each of said right hook portions is aligned with one of said left non-hook portions; and wherein the first and second bodies are arranged interstitially such that all of the gaps of the left hook portions of the first and second bodies are vertically aligned and all of the gaps of the right hook portions of the first and second bodies are vertically aligned.

2. The fence post of claim 1, the first body and second body are formed from a metal panel by a process of constant bending treatment.

3. The fence post of claim 1, wherein said left hook portions each comprise a left facing bend and a right facing gap, and said right hook portions each comprise a right facing bend and a left facing gap.

4. The fence post of claim 1, wherein the second body comprises a cover, said cover extending along a length of said first body, said cover arranged to close said left hook portions and said right hook portions.

5. The fence post of claim 4, wherein said cover abuts said left hook portions and said right hook portions.

6. The fence post of claim 4, wherein the cover is formed from a metal panel by a process of constant bending treatment.

7. The fence post of claim 1, wherein the base portion has an internal cavity.

8. The fence post of claim 1, wherein a shape of said second body is similar to a shape of said first body, and said second body has a different orientation from said first body.

9. A fence comprising:

a fence post comprising a first body and a second body adjacent to said first body;

said first body comprising a base portion, a first left side wing and a first right side wing, said first body having an internal cavity;

said first left side wing comprising a plurality of first left hook portions, each of which defines a vertical gap having a rightward oriented opening positioned in front of the first left side wing, said first left hook portions aligned with one another;

said first right side wing comprising a plurality of first right hook portions, each of which defines a vertical gap having a leftward oriented opening positioned in front of the first right side wing, said first right hook portions aligned with one another;

said second body comprising a second left side wing and a second right side wing;

said second left side wing comprising a plurality of second left hook portions aligned with one another, each of which defines a vertical gap having a rightward oriented opening positioned behind the second left side wing, said second left hook portions interlacing with said first left hook portions such that all of the gaps of the first and second left hook portions are vertically aligned;

said second right side wing comprising a plurality of second right hook portions aligned with one another, each of which defines a vertical gap having a leftward oriented opening positioned in front of the second right side wing, said second right hook portions interlacing with said first right hook portions such that all of the gaps of the first and second right hook portions are vertically aligned;

a first fence panel; and a second fence panel;

wherein said first fence panel engages said first left hook portions and said second left hook portions and extends to a first side of said fence post, and said second fence panel engages said first right hook portions and said second right hook portions and extends to a second side of said fence post.

10. The fence of claim 9, said fence post formed from a metal panel by a process of constant bending treatment.

11. The fence post of claim 9, wherein the second body comprises a cover, said cover extending along a length of said first body, said cover arranged to close said left hook portions and said right hook portions.

12. The fence of claim 9, wherein a shape of said second body is similar to a shape of said first body, and said second body has a different orientation from said first body.

* * * * *